US005936599A

United States Patent [19]

Reymond

[11] Patent Number: 5,936,599

[45] Date of Patent: Aug. 10, 1999

[54] AC POWERED LIGHT EMITTING DIODE ARRAY CIRCUITS FOR USE IN TRAFFIC SIGNAL DISPLAYS

[76] Inventor: Welles Reymond, 380 Hitchock Rd, #84, Waterbury, Conn. 06705

[21] Appl. No.: 09/078,072

[22] Filed: May 13, 1998

Related U.S. Application Data

[63] Continuation of application No. 08/379,973, Jan. 27, 1995, abandoned.

[51] Int. Cl.[6] ..... G09G 3/36

[52] U.S. Cl. ..... 345/82; 345/46

[58] Field of Search ..... 345/82, 83, 46, 345/39

[56] References Cited

U.S. PATENT DOCUMENTS

| | | | |
|---|---|---|---|
| 3,676,735 | 7/1972 | Roche | 315/207 |
| 3,761,668 | 9/1973 | Harnden, Jr. | 219/10.49 |
| 3,869,641 | 3/1975 | Goldberg | 313/135 |
| 3,898,410 | 8/1975 | Peters, Jr. | 219/10.49 |
| 3,925,705 | 12/1975 | Elms et al. | 315/246 |
| 3,989,916 | 11/1976 | Amagami | 219/10.49 |
| 4,030,017 | 6/1977 | Brown | 321/9 R |
| 4,074,101 | 2/1978 | Kiuchi | 219/10.49 |
| 4,129,767 | 12/1978 | Amagami | 219/10.49 |
| 4,151,387 | 4/1979 | Peters, Jr. | 219/10.49 |
| 4,211,955 | 7/1980 | Ray | 315/53 |
| 4,212,054 | 7/1980 | Seki | 363/53 |
| 4,271,408 | 6/1981 | Teshima | 340/702 |
| 4,298,869 | 11/1981 | Okuno | 340/782 |
| 4,316,125 | 2/1982 | Noguchi | 315/241 R |
| 4,320,273 | 3/1982 | Kiuchi | 219/10.49 |
| 4,321,598 | 3/1982 | Warner | 340/782 |
| 4,329,625 | 5/1982 | Nishizawa | 315/158 |
| 4,365,244 | 12/1982 | Gillessen | 340/782 |
| 4,367,471 | 1/1983 | Gillessen | 340/825.82 |
| 4,396,823 | 8/1983 | Nihei | 219/137 |
| 4,541,899 | 9/1985 | Mase et al. | 204/1 T |
| 4,595,920 | 6/1986 | Runyan | 340/805 |
| 4,628,427 | 12/1986 | Marvakov | 363/27 |
| 4,682,147 | 7/1987 | Bowman | 340/286 R |
| 4,749,836 | 6/1988 | Matsuo | 219/10.77 |
| 4,857,920 | 8/1989 | Kataoka | 340/907 |
| 4,939,426 | 7/1990 | Menard et al. | 315/192 |
| 4,954,822 | 9/1990 | Borenstein | 340/925 |
| 4,955,890 | 9/1990 | Kammiller | 363/44 |
| 4,959,766 | 9/1990 | Jain | 363/48 |
| 5,155,669 | 10/1992 | Yamuro | 362/252 |
| 5,187,377 | 2/1993 | Katoh | 257/89 |
| 5,257,020 | 10/1993 | Morse | 340/908.1 |
| 5,313,187 | 5/1994 | Choi | 340/331 |
| 5,323,305 | 6/1994 | Ikeda | 363/98 |
| 5,357,078 | 10/1994 | Smith et al. | 219/130.51 |
| 5,457,450 | 10/1995 | Deese et al. | 340/912 |
| 5,504,398 | 4/1996 | Rothenbuhler | 315/209 R |
| 5,528,484 | 6/1996 | Hayashi | 363/47 |
| 5,663,719 | 9/1997 | Deese et al. | 340/912 |

*Primary Examiner*—Richard A. Hjerpe
*Assistant Examiner*—Ricardo Osorio
*Attorney, Agent, or Firm*—David P. Gordon; David S. Jacobson; Thomas A. Gallagher

[57] ABSTRACT

An LED array circuit includes a number of series connected LED pairs, each pair including two parallel connected oppositely polarized LEDS. The array is coupled to a standard AC voltage source in series with an inductor L having Q>5 and a reactance which is equivalent to the resistance of a current limiting resistor. The use of an inductor in place of a resistor increases the efficiency of the array to approximately 80%. The efficiency of the array is increased even further by coupling a capacitor parallel to the array and by tuning the inductor and capacitor to the frequency of the AC voltage source. According to one embodiment of the invention, a somg;e retro-fittable unit is provided wherein an inductor, a capacitor, and an array of LEDs are contained in a housing having substantially the same size and shape as a standard incandescent bulb or the lens/filter used in a traffic signal display. According to another embodiment of the invention, a single module is provided with a plurality of LED arrays, with each LED array having its own capacitor coupled in parallel thereto, and its own series coupled switch. The module is coupled to and across the AC voltage source, with one node of the module coupled to the AC voltage source by an inductor.

29 Claims, 5 Drawing Sheets

AC POWERED LIGHT EMITTING DIODE ARRAY CIRCUITS FOR USE IN TRAFFIC SIGNAL DISPLAYS

This is a continuation of presently U.S. Ser. No. 08/379,973, filed Jan. 27, 1995, now abandoned.

BACKGROUND OF THE INVENTION

1. Field of the Invention

The invention relates to light emitting diode arrays. More particularly, the invention relates to circuits incorporating light emitting diode arrays which are powered by an alternating current and which are advantageously used in traffic signal and other displays.

2. State of the Art

Modern traffic signal systems include two major components: the controller and the display (lights). The technology of modern traffic signal controllers is quite evolved and includes modern computer technology which incorporates traffic flow sensors, timers, and the like. Over the last seventy years, however, traffic signal displays have not changed significantly. The displays utilize high power broad spectrum incandescent bulbs with colored filters to produce the desired traffic signal color. It is well known that traffic signal displays are inefficient, as they consume large amounts of energy in order to produce a display which is bright enough to be seen in broad daylight. The inefficiency of the displays is due in part to the general inefficiency of incandescent bulbs, and is exacerbated by the fact that much of the light energy produced by the bulbs is wasted by filtering the light. Moreover, traffic signal displays require frequent maintenance. Incandescent bulbs have a relatively short life span, typically less than eight thousand hours, shorter still if switched on and off frequently and if constantly exposed to the elements; all of which are the case with traffic signals.

It is known in the art to use a light emitting diode (LED) array in lieu of incandescent bulbs in a traffic signal. Such arrays are disclosed, for example, in U.S. Pat. No. 4,271,408 to Teshima et al., U.S. Pat. No. 4,298,869 to Okuno, and U.S. Pat. No. 4,954,822 to Borenstein, the complete disclosures of which are hereby incorporated herein by reference. An LED array can provide many advantages when used in lieu of an incandescent bulb. The primary advantages are that an LED array is much more efficient than an incandescent bulb and requires little or no maintenance. In most cases, an LED array will consume about one tenth the power that a filtered incandescent bulb will consume to produce the same light output. The life cycle costs of a traffic signal using an LED array in lieu of an incandescent bulb is also significantly reduced since incandescent bulbs used in traffic signals typically must be replaced once or twice a year. A well designed LED array could be expected to function for more than twenty years before requiring replacement. Another, less apparent advantage is that a single array can be used to display many different illuminated symbols such as international symbols for turn only, do not enter, walk, don't walk, etc. The LED array is more resistant to the elements and is more mechanically durable than an incandescent bulb. It is also possible to achieve a higher flashing rate with an LED array than with an incandescent bulb. It is known in industrial psychology that certain high flashing rates are more apt to draw attention than other slower flashing rates. In addition, an LED array does not require a light reflector like the relatively large parabolical reflectors used with incandescent bulbs. The elimination of the reflector is an advantage because during certain seasons at certain times of day, sunlight can be reflected off the reflector in an incandescent bulb traffic signal and cause a confusing display. Yet another advantage of an LED array is that, if it is properly arranged, when faults develop in the array, the entire array need not fail.

Despite all of the advantages of using LED arrays in traffic signal displays, there are several concerns which have prevented their widespread adoption. The first and perhaps the most significant concern is that an LED array is not easily retro-fitted to an existing traffic signal. This is primarily because existing incandescent displays operate with a "standard" 120 volt 60 Hz AC power supply. LEDs require a DC current of approximately 5 to 20 milliamps and a forward operating voltage of between 1.5 to 2.5 volts depending on the wavelength of the emitted light and the semiconductor material used. Another reason why retrofitting is difficult is because the "standard" traffic signal housings are designed to accept a "standard" incandescent bulb. These issues have been addressed in the art. As shown in prior art FIG. 1, an arrangement which has been proposed by Borenstein, supra., uses a step down isolation transformer 10 with a center tapped full-wave rectifier 12 to drive an array of LEDs 14 which are connected in parallel. Although Borenstein does not specify exactly how many LEDs are to be used, a typical traffic signal display will require between twenty and eighty LEDs. Assuming that fifty LEDs are used with Borenstein's power supply, it is difficult to imagine that an efficiency of more than 50% could be achieved. Moreover, the most common LED failure mode is a short where the LED becomes a short circuit. If the LEDs are arranged in parallel as taught by Borenstein, a short fault in one LED will disable the entire array.

As shown in prior art FIG. 2, a simpler arrangement which has been proposed by Teshima et al., supra., uses a rectifier bridge 16 to convert the AC power supply to pulsating DC and an array of sixty-two 1.6 volt LEDs 18 in series with a resistor 20. A smoothing capacitor 22 is connected in parallel with the array for absorbing ripple components of the power supply. Unfortunately, the rectifier circuit adds expense to the system and makes it less reliable. The resistor wastes energy and lowers the efficiency of the system. While Teshima et al. suggests that the rectifier can be eliminated by using pairs of oppositely polarized LEDs connected in series through a protective resistor, little information is given about this arrangement.

A simpler solution has been proposed by Okuno, supra., which is shown in prior art FIG. 3. Okuno avoids the use of a rectifier bridge by providing an array of LEDs 24 which are connected in series and polarized in one direction and an array of LEDs 26 which are connected in series and polarized in the opposite direction. The two arrays 24 and 26 are connected in parallel so that a respective array is illuminated during each half cycle of the AC power supply. According to Okuno, however, a current limiting resistor 28 (a generator resistor) must be connected in series with the arrays. Assuming each array 24 and 26 includes twenty-five LEDs, the value of the resistor 28 should be approximately 3300 ohms to produce the desired average LED current. Since approximately 70% of the line voltage is dropped across the resistor 28, the resistor is the dominant factor in determining the LED current and energy is wasted by the resistor. In this example, the arrangement has an efficiency of only about 35% and the LED current has a range of ±25%. If a greater number of LEDS were used, the efficiency would increase, but the current range would widen.

SUMMARY OF THE INVENTION

It is therefore an object of the invention to provide a circuit incorporating an AC line powered LED array which is suitable for retro-fitting in an existing traffic signal display.

It is also an object of the invention to provide an AC line powered LED array circuit which does not require a rectifier bridge or a transformer.

It is another object of the invention to provide an AC line powered LED array circuit which has enhanced efficiency and does not use a current limiting resistance.

It is a further object of the invention to provide a highly efficient, low cost AC powered LED array circuit for use in traffic signal and other displays.

It is also an object of the invention to provide an AC line powered LED array having a large number of LEDs connected in series so that the cumulative voltage across the array may be comparable to or greater than an AC line voltage.

It is another object of the invention to provide an AC line powered LED array circuit which provides a relatively constant current through the LED array regardless of the type or number of LEDs in the array.

It is a further object of the invention to provide an AC line powered LED array and circuit which is highly fault tolerant.

It is still another object of the invention to provide AC line powered LED display which is compatible with existing traffic signal controllers.

In accord with these objects which will be discussed in detail below, the LED array circuit of the present invention includes a number of series connected LED pairs, each pair including two parallel connected oppositely polarized LEDs, which are coupled to a standard AC voltage source by an inductor which is arranged in series between the AC voltage source and the LED array. The inductor is preferably provided with a Q>5 and a reactance which is equivalent to the resistance of a current generator or current limiting resistor. The use of an inductor in place of a resistor increases the efficiency of the array circuit to approximately 80% if the inductor is properly chosen. The efficiency of the array circuit is increased even further by coupling a capacitor in parallel to the array, thereby generating an impedance converter which converts to AC voltage source into a high impedance AC current source. By tuning the inductor and capacitor of the impedance converter to the frequency of the AC voltage source, the efficiency of the array is greater than 80%. Moreover, when the capacitor is included in the circuit, the power factor of the circuit is improved, non-linearity of the circuit is diluted, the impedance of the source is increased, and the LED array may include a large number of LEDs (e.g., forty pairs or more). In fact, so many LEDs may be included in the array such that the voltage drop across the array is greater than the AC line peak voltage itself.

According to a preferred embodiment of the invention, the LED array and circuit are mounted on a circuit board which is connected by spacers to a clear circular disk. The disk is dimensioned to take the place of a standard traffic signal filter/lens. This embodiment is retro-fitted to an existing traffic signal by removing the bulb, reflector, and filter/lens from the traffic signal and mounting the clear circular disk in place of the filter. Alternatively, and in accord with another embodiment of the invention, a single retro-fittable unit is provided wherein an inductor, a capacitor, and an array of LEDs are contained in a housing having substantially the same size and shape as a standard incandescent bulb used in a traffic signal display. According to yet another embodiment of the invention, a plurality of individually switched arrays are contained in a single module where a first terminal of each array is coupled to a common point which is series connected through a single inductor to the AC voltage source, and a separate capacitor is coupled parallel to each array. The second terminal of each array is coupled through a respective individual switch to the AC voltage source. The second embodiment provides a module for several independently operable mutually exclusive displays.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
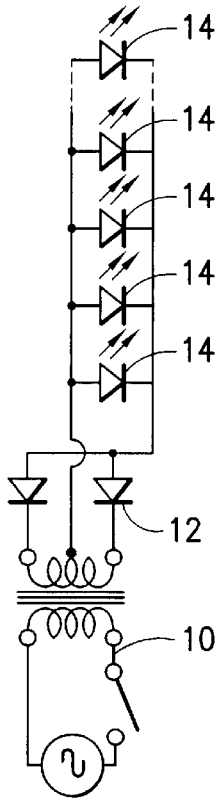
FIG.1 PRIOR ART
FIG. 1 is a schematic diagram of a prior art LED array circuit using a transformed and rectified power supply with LEDs coupled in parallel.
Figure 2:
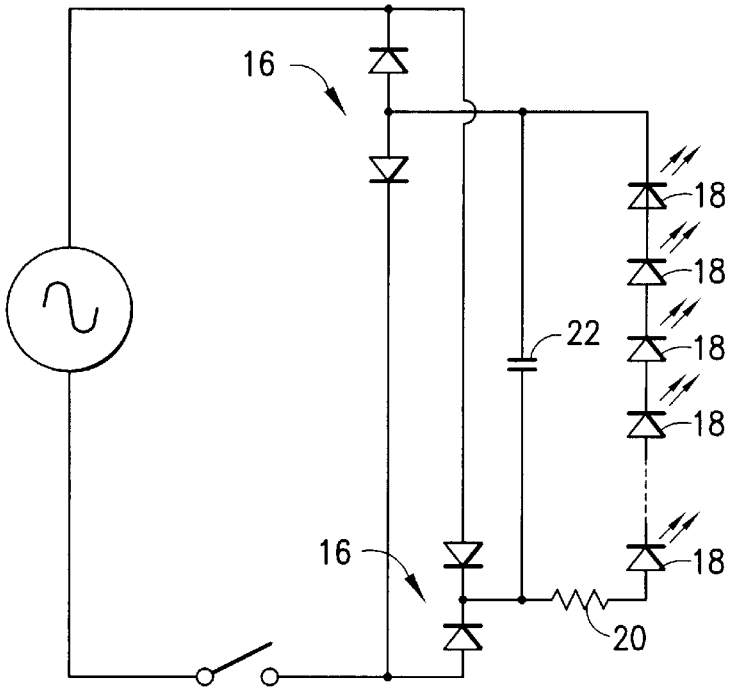
FIG.2 PRIOR ART
FIG. 2 is a schematic diagram of a prior art LED array circuit using a filtered and rectified power supply with LEDs coupled in series with a current limiting resistor.
Figure 3:
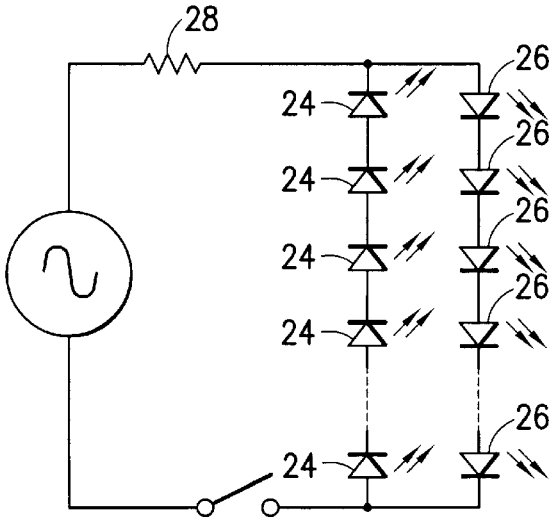
FIG.3 PRIOR ART
FIG. 3 is a schematic diagram of a prior art LED array circuit with oppositely polarized series connected LEDs coupled in series with a current limiting resistor.
Figure 4:
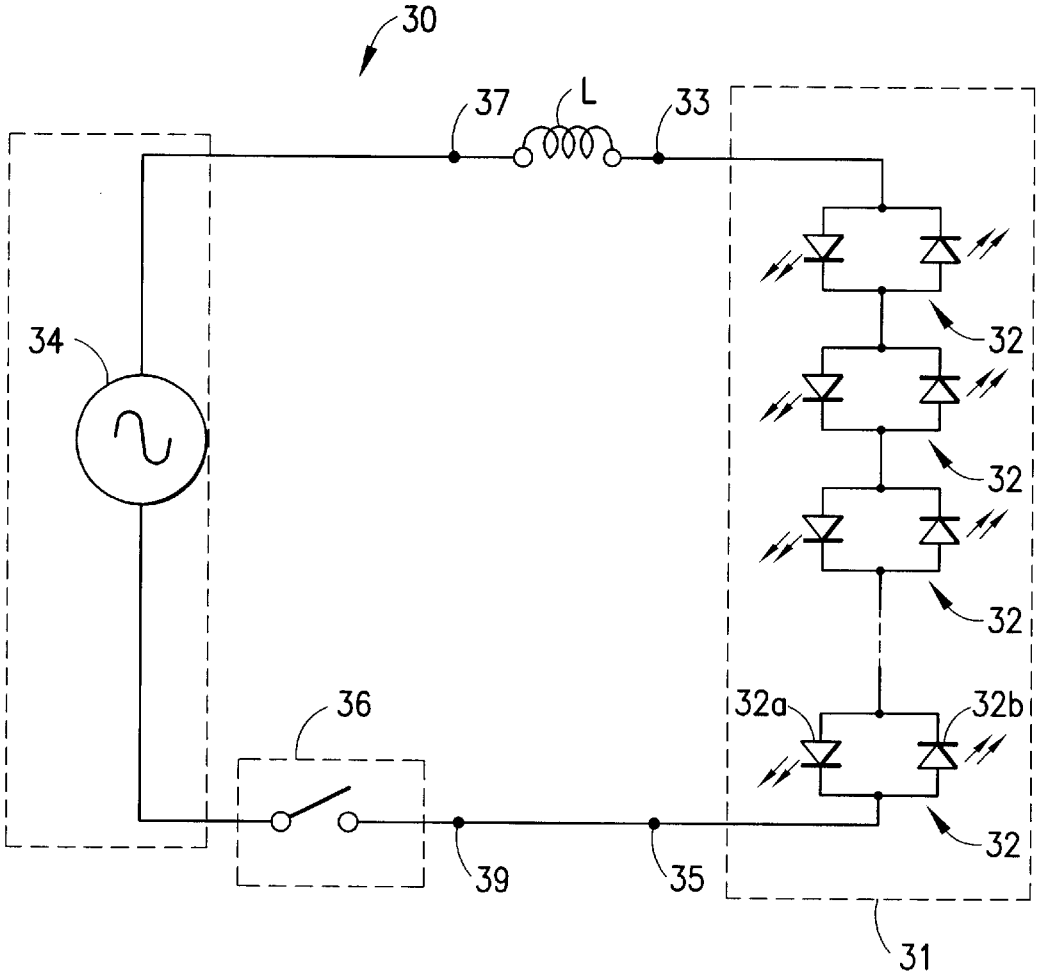
FIG. 4 is a schematic diagram of a first embodiment of an LED array circuit according to the invention.

Referring now to FIG. 4, a first embodiment of an LED array circuit 30 according to the invention includes an array of LEDs 31 arranged as a plurality of LED pairs 32, and an inductor L. The LED pairs 32 each include two parallel coupled LEDs 32*a*, 32*b* which are oppositely polarized. The LED pairs 32 are coupled to each other in series to form the LED array 31. A first terminal or node 33 of the array is coupled to an AC voltage source 34 through the series connected inductor L, with the second terminal or node 35 of the array 31 coupled to the AC voltage source through a switch 36. It will be appreciated that the switch 36 shown in FIG. 4 is merely representative of some type of switching circuit and in practice will likely be part of a traffic signal controller. It will also be understood that the connection of the circuit 30 to the AC voltage source 34 is preferably a removable connection as represented in FIG. 4 by removable couplings 37 and 39. According to the invention, the inductor L is chosen to have a reactance equivalent to the resistance of a current generator or current limiting resistor and to have Q>5. The use of inductor L with the array 30 produces an efficiency of about 80% and achieves all of the advantages of LED arrays without suffering the disadvantages of the current limiting resistor of the prior art.

It will be appreciated that during one half cycle of the AC voltage source, one of the LEDs in each pair will light and during the other half cycle, the other LED in each pair will light. One of the advantages of arranging the LEDs as shown (i.e. in parallel oppositely polarized pairs which are series connected) is that if an LED faults either closed (short) or open, only that LED or one LED pair will be disabled. That is, if an LED shorts, all of the remaining LEDs will continue to function except for the one which is paired with the shorted LED and which will be shorted thereby. If, on the other hand, a red LED faults open, the LED which is paired with it will be forced to conduct reverse voltage during the half cycle in which the open faulted LED would have lit.

Those skilled in the art should appreciate that the circuit of FIG. 4 exhibits non-linear characteristics and that the most important factor in powering the LEDs is the average current which flows through the array of LEDs. If the voltage drop across the LED array is small relative to the peak line voltage, the current through the array is substantially related to the RMS short circuit current $I_{SC}$ through the inductor L which is expressed below according to the approximation:

$$I_{SC} \approx \frac{V}{Z_L} \tag{1}$$

where V is the RMS line voltage and $Z_L$ is the impedance of the inductor L. Since it is the average current rather than the RMS current which is of importance to the LEDs, the average short circuit current $I_{SC(AVG)}$ through the inductor L over one complete AC cycle is expressed according to approximation:

$$I_{SC(AVG)} \approx \left(\frac{2\sqrt{2}}{\pi}\right) I_{SC} \tag{2}$$

It will also be appreciated that the impedance $Z_L$ of the inductor L is a complex number related to its inductance L by:

$$Z_L = |j2\pi FL| \tag{3}$$

where F is the AC line frequency and j is the square root of (−1). By combining the above approximations (1) and (2) and equation (3), the average short circuit current through the inductor L can be expressed according to:

$$I_{SC(AVG)} \approx \left(\frac{2\sqrt{2}}{\pi}\right)\left(\frac{V}{|j2\pi FL|}\right) \approx \frac{V\sqrt{2}}{\pi^2 FL} \tag{4}$$

Since each LED is ON for a half cycle and OFF for a half cycle, the average current through current $I_{LED(AVG)}$ through the array during each half cycle will be substantially equal to one half the average short circuit current $I_{SC(AVG)}$ through the inductor L so long as the voltage drop across the LED array is relatively small compared to the peak AC line voltage. For example, utilizing the relationship (4) above with an AC source of 120 V RMS at 60 Hz, an appropriate average current of approximately 24 ma through an array of approximately twenty LEDs every half cycle can be controlled by an inductor L having an inductance of 6 Henries. The inductor L will maintain an appropriate average current through the array so long as the voltage drop across the array is relatively small as compared to the peak AC line voltage.

Figure 5:
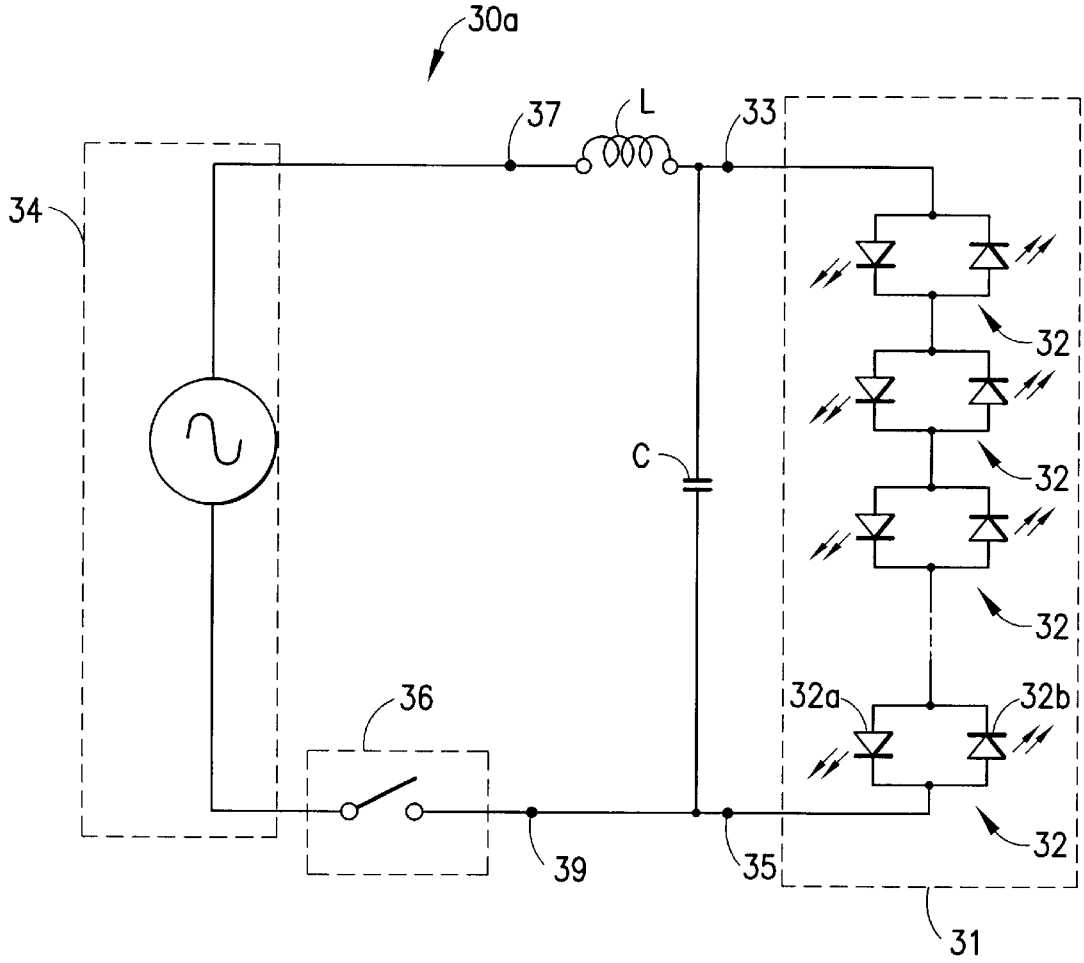
FIG. 5 is a schematic diagram of a second embodiment of an LED array circuit according to the invention.

The efficiency, power factor, and control of current in the circuit of FIG. 4 can be further enhanced by the addition of a capacitor C as shown in FIG. 5. The circuit 30a of FIG. 5 is substantially the same as that in FIG. 4, but with the addition of capacitor C which is coupled in parallel to the LED array 31 across the terminals 33 and 35. In this circuit, the inductance of the inductor L is preferably chosen according to the relationship (4) given above. The L-C circuit shown in FIG. 5 is not a filter circuit but is an impedance converter which effectively converts the AC voltage source into a high impedance AC current source when the L-C circuit is tuned to the frequency of the AC source according to approximation:

$$F \approx \frac{1}{2\pi\sqrt{LC}} \tag{5}$$

Thus, the value of the capacitor C is preferably chosen according to the approximation:

$$C \approx \frac{1}{(2\pi F)^2 L} \tag{6}$$

with a frequency of 60 Hz, and an inductor of approximately 6 Henries, the desired capacitance would be approximately 1 $\mu$F. This arrangement effectively increases the current generator impedance $Z_g$ of the circuit by a factor of Q such that $|Z_g| \approx QX_L$, with $X_L$ being the reactance of the inductor L. It also increases the open circuit voltage $V_{DC}$ by a factor of Q so that $V_{DC} \approx QV$. The AC voltage source therefore appears to the LED array as a current source even when the voltage drop across the array is comparable to the peak AC line voltage. Because of the high current generator impedance, the same tuned circuit can tolerate a wide range in the number and types of LED pairs without materially affecting the LED current. Thus, a standard tuned circuit can be used with many different types of LED arrays. Moreover, in principle, the tuned circuit can generate a voltage across the LED array which may be greater than the AC line voltage. Therefore, a very large number of LEDs can be used in the array. Indeed, in a preferred embodiment of the invention, forty or more pairs of LEDs are utilized. It should be noted that the inductor L, when used in the AC powered circuits described above, provides high impedance without energy wasting resistance.

Figure 6:
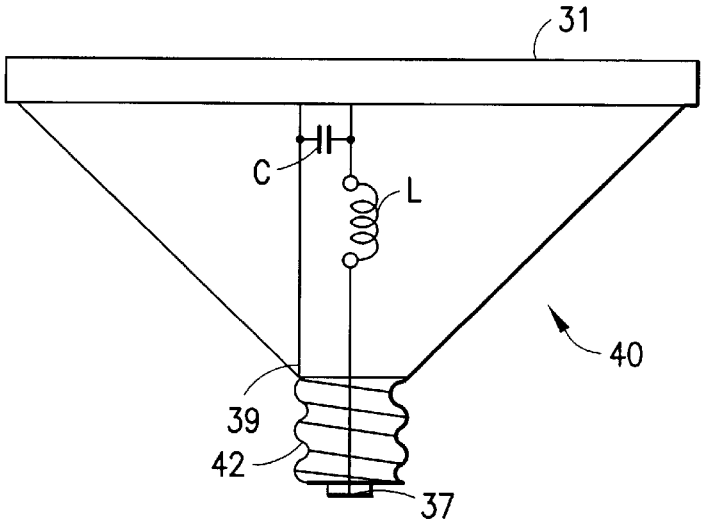
FIG. 6 is a partially transparent side elevation view of a housing for the LED array circuit of FIG. 5 which is adapted for retro-fitting in an existing traffic signal display.

Referring now to FIG. 6, those skilled in the art will appreciate that the LED array 31, the inductor L and the capacitor C can be mounted in a housing 40 having the same size and shape as a conventional incandescent bulb with a conventional base connector 42. In this manner, the array is easily retro-fitted to existing traffic signal displays which utilize this type of fixture.

Figure 7:
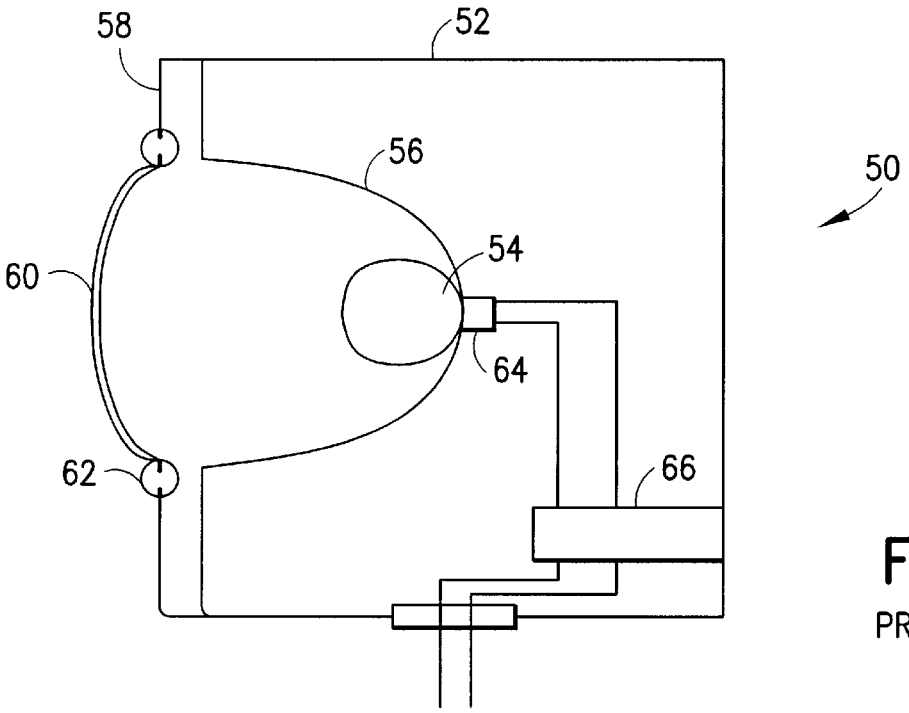
FIG.7 PRIOR ART
FIG. 7 is a cross sectional schematic view of a prior art traffic signal display having an incandescent bulb, a reflector, and a colored filter/lens.

The invention may be easily adapted to replace incandescent lighting in virtually any kind of traffic signal display unit. FIG. 7 shows a popular existing traffic signal display 50 having a weather tight enclosure or casing 52 which contains an incandescent bulb 54 and a parabolic reflector 56. The inside of the enclosure 52 is accessible via a hinged door 58 which carries a colored lens/filter 60 (e.g. red, yellow, or green) fitted to an opening in the door with a grommet 62. The bulb 54 is held in a socket 64 which is electrically coupled to a voltage source (not shown) via a quick connect block 66. The bulb 54, reflector 56, socket 64 and attached wires are also hinged to the enclosure 52. Thus the interior elements of the display 50 are all easily accessible and replaceable.

Figure 8:
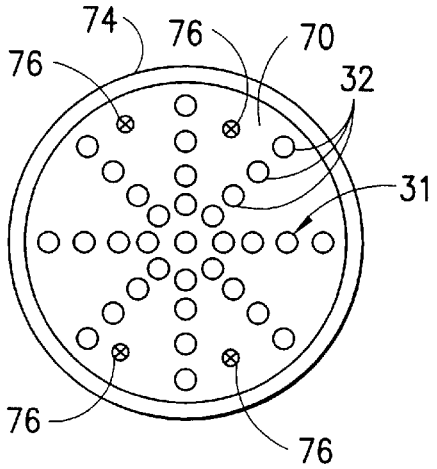
FIG. 8 is a side elevation schematic view of an LED array according to the invention mounted on a circular disk for retro-fitting in an existing traffic signal display.
Figure 9:
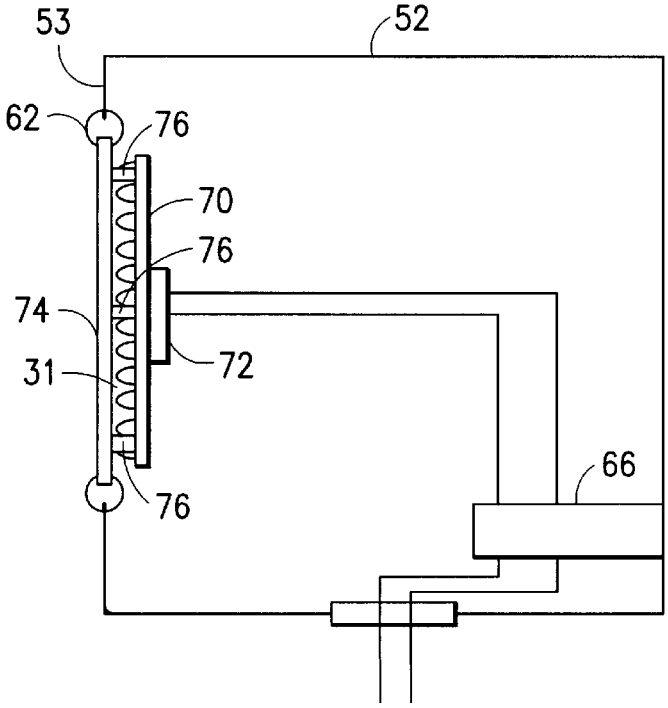
FIG. 9 is a cross sectional view similar to FIG. 7 showing the LED array of FIG. 8 installed in an existing traffic signal display.

According to a preferred embodiment of the invention, and as shown in FIGS. 8 and 9, an LED array 31 is mounted on one side of a circuit board 70 which is provided with circuit traces and elements 72 on its other side. The circuit elements and traces may include the inductor L, the capacitor C, and the connections of the array 31 as described with reference to FIGS. 4 and 5 above. The circuit board 70 is coupled to a clear plastic disk 74 by a number of spacers 76 so that the LEDs 32 in the array 31 face the disk 74 as seen best in FIG. 9. Preferably, both the disk 74 and the circuit board 70 are circular. The disk 72 is fitted with a grommet 62 which is substantially the same as the grommet 62 used to hold the filter/lens 60 in the prior art display 50 described above. The prior art display 50 of FIG. 7 is modified by removing the lens/filter 60 with its grommet 62 and by removing the bulb 54, reflector 56, and socket 64. The disk 74 with its grommet 62 is fitted into the opening in the hinged door 53 and the circuit 72 is electrically coupled to the quick connect block 66. It has been found that the portion of the circuit board 70 which faces the disk 74 should be painted black before mounting the LEDs 32. This prevents unwanted reflection off the circuit board during bright daylight hours. It will be appreciated that the circuit 72 need not be mounted on the circuit board 70. All or part of the circuit 72 could be mounted off the board 70 inside the enclosure 52. As a practical matter, it may be advantageous to mount all of the circuit except for the inductor L on the circuit board 70 and mount the inductor L inside the enclosure 52.

Figure 10:
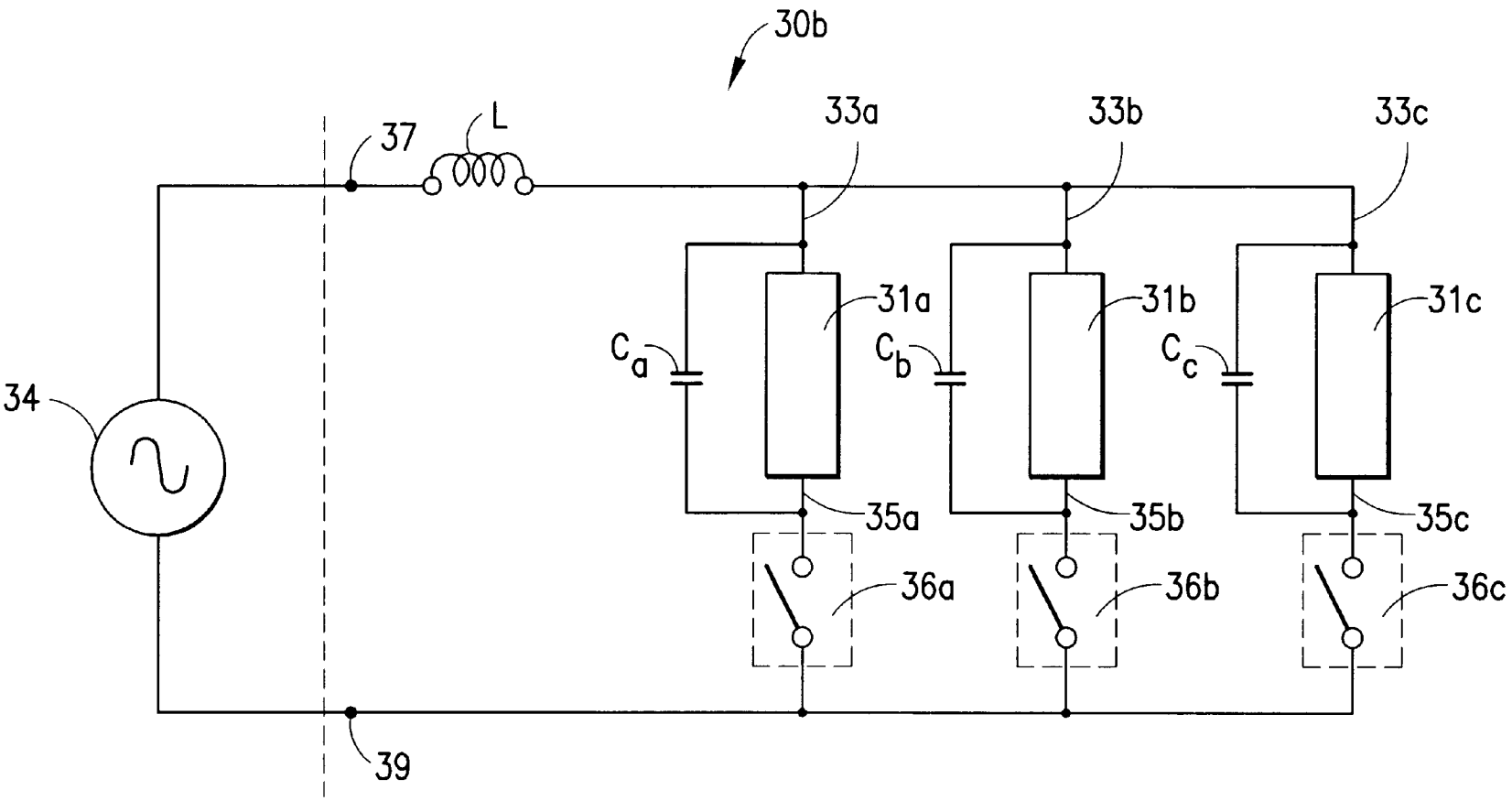
FIG. 10 is a schematic diagram of a third embodiment of an LED array circuit according to the invention.

FIG. 10 shows a circuit 30*b* utilizing multiple LED arrays according to the invention. LED arrays 31*a*, 31*b*, 31*c*, each of which are substantially the same as the LED array 31 shown in FIG. 5, are coupled by their first terminals 33*a*–33*c* to the AC voltage source 34 through a common inductor L and are coupled by their second terminals 35*a*–35*c* through individual respective switches 36*a*–36*c* to the AC voltage source. Capacitors $C_a$, $C_b$, $C_c$ are respectively coupled in parallel to each array 31*a*, 31*b*, 31*c* across their respective terminals. The circuit shown in FIG. 10 assumes that each array is operated in mutual exclusivity so that the L-C circuit as described above operates in the same manner in this circuit when each array is turned on. This type of circuit is well suited for a multiple display traffic signal. For example, if the LEDs in array 31*a* are all red light emitting, the LEDs in array 31*b* are all yellow light emitting, and the LEDs in array 31*c* are all green light emitting, the circuit is well suited for use in a red, yellow, and green traffic light where only one LED array is turned on at any given time. Using the circuit of FIG. 10, a single inductor L can be shared by all of the LED arrays, thereby reducing the cost of the traffic signal display unit.

There have been described and illustrated herein several embodiments of an AC powered LED array and circuits associated with it. While particular embodiments of the invention have been described, it is not intended that the invention be limited thereto, as it is intended that the invention be as broad in scope as the art will allow and that the specification be read likewise. Thus, while particular configurations have been disclosed in reference to a housing for the LED array and associated circuits, it will be appreciated that other configurations could be used as well. Furthermore, while the multiple array embodiment has been disclosed as having three arrays, it will be understood that different numbers of arrays can achieve the same or similar function as disclosed herein. Additionally, while the circuit of the invention has been described with reference to traffic signal displays, it will be appreciated that the circuit is useful in any AC powered illumination apparatus, including, but not limited to illuminated safety displays such as fire alarm indicators, exit signs, airport and shipping displays, etc. It will therefore be appreciated by those skilled in the art that yet other modifications could be made to the provided invention without deviating from its spirit and scope as so claimed.

I claim:

1. An LED array circuit powered by a substantially sinusoidal AC voltage source of known frequency, comprising:

a) a first set of LEDs arranged as a first plurality of LED pairs, each LED pair comprising two oppositely polarized LEDs coupled to each other in parallel, and each LED pair being series connected to another LED pair, said first set of LEDs having first and second terminal nodes, coupled to and across the substantially sinusoidal AC voltage source;

b) an inductor arranged in series with and coupling one of said first and second terminal nodes to the substantially sinusoidal AC voltage source, said inductor having a 0 value and reactance chosen for improved power efficiency; and c) a first capacitor coupled in parallel to said first set of LEDs at said first and second terminal nodes, wherein said inductor and said first capacitor form an impedance converter circuit which is tuned to the known frequency of the substantially sinusoidal AC voltage source thereby effectively converting the AC voltage source into substantially an AC current source, said substantially AC current source with said first set of LEDs providing said circuit with improved power efficiency.

2. A circuit according to claim 1, wherein:

said inductor has a Q greater than five.

3. A circuit according to claim 1, wherein:

said first set of LEDs comprises at least forty LEDs.

4. A circuit according to claim 1, wherein:

the values of said inductor and said first capacitor are chosen according to the approximate relationship $F \approx \frac{1}{2\pi\sqrt{LC}}$, where F is the frequency of the substantially sinusoidal AC voltage source, L is the value of said inductor, and C is the value of said first capacitor.

5. A circuit according to claim 1, further comprising:

d) a second plurality of LED pairs, each second plurality of LED pairs comprising two oppositely polarized LEDs, said second plurality of LED pairs being coupled to each other in series to form a second set of series connected LEDs having two terminal nodes coupled to and across the substantially sinusoidal AC voltage source, one of said two terminal nodes of the second plurality of series connected LEDs being coupled to the substantially sinusoidal AC voltage source by said inductor.

6. A circuit according to claim 5, further comprising:

e) a first switch means for coupling said first set of series connected LEDs to the substantially sinusoidal AC voltage source; and f) a second switch means for coupling said second set of series connected LEDs to the substantially sinusoidal AC voltage source.

7. A circuit according to claim 1, further comprising:

d) a second plurality of LED pairs, each pair of said second plurality of LED pairs comprising two oppositely polarized LEDs, said second plurality of LED pairs being coupled to each other in series to form a second set of series connected LEDs having two terminal nodes coupled to and across said substantially sinusoidal AC voltage source, with one of said terminal nodes being coupled by said inductor to the substantially sinusoidal AC voltage source; and e) a second capacitor coupled in parallel with said second set of series connected LEDs.

8. A circuit according to claim 7, further comprising:

f) a first switch means for coupling said first set of series connected LEDs to the substantially sinusoidal AC voltage source; and g) a second switch means for coupling said second set of series connected LEDs to the substantially sinusoidal AC voltage source.

9. A circuit according to claim 1, wherein:

said first set of series connected LEDs are mounted on one side of a substantially circular circuit board, and said substantially circular circuit board is attached to a substantially circular clear plastic disk with spacers such that said first plurality of series connected LEDs face said clear plastic disk.

10. An LED array circuit powered by a substantially sinusoidal AC voltage source of known frequency, comprising:

a) a plurality of series connected LEDs having first and second terminal nodes, coupled to and across the substantially sinusoidal AC voltage source, said plurality of series connected LEDs comprising a plurality of LED pairs, each LED pair comprising two oppositely polarized LEDs coupled to each other in parallel, and each LED pair being series connected to another LED pair;

b) an inductor arranged in series with and coupling one of said first and second terminal nodes to the substantially sinusoidal AC voltage source; and c) a first capacitor coupled in parallel to said plurality of series connected LEDs at said first and second terminal nodes, wherein said inductor and said first capacitor form an impedance converter circuit which is tuned to the known frequency of the substantially sinusoidal AC voltage source thereby effectively converting the AC voltage source into substantially an AC current source, wherein said plurality of series connected LEDs comprising a number of LEDs sufficient to cause a voltage drop across said first set of LEDs to be greater than a peak voltage of the AC voltage source.

11. A circuit according to claim 10, wherein:

said inductor has a Q greater than five.

12. A circuit according to claim 10, wherein:

the values of said inductor and said first capacitor are chosen according to the approximate relationship $F \approx \frac{1}{2\pi\sqrt{LC}}$, where F is the frequency of the substantially sinusoidal AC voltage source, L is the value of said inductor, and C is the value of said first capacitor.

13. A circuit according to claim 1, wherein:

said Q value is at least five.

14. An LED array circuit powered by a substantially sinusoidal AC voltage source of known frequency, comprising:

a) a first set of LEDs arranged as a first plurality of LED pairs, each LED pair comprising two oppositely polarized LEDs coupled to each other in parallel, and each LED pair being series connected to another LED pair, said first set of LEDs having first and second terminal nodes, coupled to and across the substantially sinusoidal AC voltage source;

b) an inductor arranged in series with and coupling one of said first and second terminal nodes to the substantially sinusoidal AC voltage source; and c) a first capacitor coupled in parallel to said first set of LEDs at said first and second terminal nodes, wherein said inductor and said first capacitor form an impedance converter circuit which is tuned to the known frequency of the substantially sinusoidal AC voltage source thereby effectively converting the AC voltage source into substantially an AC current source, said inductor having an inductance value chosen to provide a desired current for lighting said first set of LEDs, and said inductor chosen to have a high impedance while providing energy efficiency.

15. A circuit according to claim 14, further comprising:

d) a second plurality of LED pairs, each second plurality of LED pairs comprising two oppositely polarized LEDs, said second plurality of LED pairs being coupled to each other in series to form a second set of series connected LEDs having two terminal nodes coupled to and across the substantially sinusoidal AC voltage source, one of said two terminal nodes of the second plurality of series connected LEDs being coupled to the substantially sinusoidal AC voltage source by said inductor.

16. A circuit according to claim 15, further comprising:

e) a first switch means for coupling said first set of series connected LEDs to the substantially sinusoidal AC voltage source; and f) a second switch means for coupling said second set of series connected LEDs to the substantially sinusoidal AC voltage source.

17. A circuit according to claim 14, further comprising:

d) a second plurality of LED pairs, each pair of said second plurality of LED pairs comprising two oppositely polarized LEDs, said second plurality of LED pairs being coupled to each other in series to form a second set of series connected LEDs having two terminal nodes coupled to and across said substantially sinusoidal AC voltage source, with one of said terminal nodes being coupled by said inductor to the substantially sinusoidal AC voltage source; and e) a second capacitor coupled in parallel with said second set of series connected LEDs.

18. A circuit according to claim 17, further comprising:

f) a first switch means for coupling said first set of series connected LEDs to the substantially sinusoidal AC voltage source; and g) a second switch means for coupling said second set of series connected LEDs to the substantially sinusoidal AC voltage source.

19. A circuit according to claim 14, wherein:

said first set of series connected LEDs are mounted on one side of a substantially circular circuit board, and said substantially circular circuit board is attached to a substantially circular clear plastic disk with spacers such that said first plurality of series connected LEDs face said clear plastic disk.

20. An LED array circuit powered by a substantially sinusoidal AC voltage source, comprising:

a) a first plurality of series connected LEDs having first and second terminal nodes, coupled to and across the substantially sinusoidal AC voltage source; and b) a current limiting inductor arranged in series with and coupling one of said first and second terminal nodes to the substantially sinusoidal AC voltage source, said inductor having an inductance value chosen to provide a desired current through said LEDs, and having a Q value and reactance for improved power efficiency.

21. A circuit according to claim 20, further comprising:

c) a second plurality of series connected LEDs having two terminal nodes, one of said terminal nodes of said second plurality of LEDs being coupled to said first terminal node of said first plurality of LEDs, and the other of said terminal nodes of said second plurality of LEDs being coupled to said second of said terminal nodes of said first plurality of LEDs, such that said first plurality of LEDs are polarized in a first direction and said second plurality of LEDs are polarized in second direction opposite to said first direction.

22. A circuit according to claim 20, wherein:

said first plurality of series connected LEDs comprises a first plurality of LED pairs, each LED pair comprising two oppositely polarized LEDs coupled to each other in parallel, and each LED pair being series connected to another LED pair.

23. A circuit according to claim 22, wherein:

said inductor has a Q greater than five.

24. A circuit according to claim 20, wherein:

said inductor has a Q greater than five.

25. A circuit according to claim 22, further comprising:

c) a second plurality of LED pairs, each LED pair comprising two oppositely polarized LEDs, said second plurality of LED pairs being coupled to each other in series to form a second plurality of series connected LEDs having two terminal nodes coupled to and across the substantially sinusoidal AC voltage source, one of said two terminal nodes of the second plurality of series connected LEDs being coupled to the substantially sinusoidal AC voltage source by said inductor.

26. A circuit according to claim 25, further comprising:

d) a first switch means for coupling said first plurality of series connected LEDs to the substantially sinusoidal AC voltage source; and e) a second switch means for coupling said second plurality of series connected LEDs to the substantially sinusoidal AC voltage source.

27. A circuit according to claim 26, further comprising:

f) a first capacitor coupled in parallel to said first plurality of series connected LEDs at said first and second terminal nodes.

28. A circuit according to claim 20, further comprising:

c) a first capacitor coupled in parallel to said first plurality of series connected LEDs at said first and second terminal nodes.

29. A circuit according to claim 20, wherein:

said first plurality of series connected LEDs are mounted on one side of a substantially circular circuit board, and said substantially circular circuit board is attached to a substantially circular clear plastic disk with spacers such that said first plurality of series connected LEDs face said clear plastic disk.

* * * * *